US006811452B2

(12) United States Patent
Fujita et al.

(10) Patent No.: US 6,811,452 B2
(45) **Date of Patent: *Nov. 2, 2004**

(54) CONNECTOR WITH A RETAINER

(75) Inventors: Shinya Fujita, Yokkaichi (JP); Yuuichi Nankou, Yokkaichi (JP); Yukihiro Fukatsu, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/602,321

(22) Filed: Jun. 24, 2003

(65) Prior Publication Data

US 2004/0005822 A1 Jan. 8, 2004

(30) Foreign Application Priority Data

Jun. 24, 2002 (JP) ..... 2002-183536

(51) Int. Cl.[7] ..... H01R 13/514
(52) U.S. Cl. ..... 439/752
(58) Field of Search ..... 439/752, 595, 439/352, 596, 489

(56) References Cited

U.S. PATENT DOCUMENTS 5,378,176 A * 1/1995 Sasai ..... 439/752
5,651,703 A * 7/1997 Sasai ..... 439/752
5,830,013 A 11/1998 Saito et al.
6,497,591 B2 * 12/2002 Fujita ..... 439/752
6,595,807 B2 * 7/2003 Kashiyama ..... 439/752
6,599,154 B2 * 7/2003 Sakurai et al. ..... 439/752
6,655,999 B2 * 12/2003 Mase et al. ..... 439/752
6,702,627 B2 * 3/2004 Nankou et al. ..... 439/752
6,733,346 B2 * 5/2004 Tsuji et al. ..... 439/748

FOREIGN PATENT DOCUMENTS

EP 0 732 772 9/1996
EP 1 009 063 6/2000

* cited by examiner

*Primary Examiner*—Ross Gushi
*Assistant Examiner*—Phuongchi Nguyen
(74) *Attorney, Agent, or Firm*—Gerald E. Hespos; Anthony J. Casella

(57) ABSTRACT

A retainer mount hole (10) is open in a connector housing (1) from its bottom surface over to its opposite side surfaces, and a retainer (35) is pushed obliquely from a partial locking position to a full locking position. On the other hand, each terminal fitting (25) is provided with a projection (28) and a stabilizer (29) at the side of the projection (28). When the retainer (35) reaches the full locking position, both the projection (28) and the stabilizer (29) are engaged with the retainer (35). The projecting end of the rear end of the stabilizer (29) is pointed, thereby forming a biting portion (56). When a wire (31) connected with the terminal fitting (25) is pulled backward, the biting portion (56) bites in the retainer (35) to prevent the retainer (35) from returning.

14 Claims, 12 Drawing Sheets

CONNECTOR WITH A RETAINER

BACKGROUND OF THE INVENTION

1. Field of the Invention

The invention relates to a connector with a retainer.

2. Description of the Related Art

U.S. Pat. No. 5,378,176 discloses a side-retainer connector with a housing that has cavities for receiving terminal fittings. A retainer mount hole extends into one side surface of the housing and communicates with the cavities. A retainer can be pushed obliquely forward into the retainer mount hole for locking terminal fittings that have been inserted properly into the cavity. Additionally, the oblique movement of the retainer pushes an insufficiently inserted terminal fitting from behind and moves the terminal fitting to the proper position.

A pulling force on a wire is transmitted from the terminal fitting to the retainer. Such a pulling force will have no component normal to the inserting direction of the terminal fitting. Thus, a retainer that is inserted into a housing normal to the inserting direction of the terminal fittings cannot be displaced out of the housing by a pulling force on a wire. However, a pulling force on a wire will have a component that is oblique to the inserting direction of the terminal fitting. As a result, a component of a pulling force on a wire can urge the above-described obliquely inserted terminal fitting in a withdrawing direction.

The above-described obliquely inserted retainer has locking holes that engage locking projections on the housing to hold the retainer in a fully locked position. Thus, there is little likelihood that the retainer will be displaced by a pulling force on the wire. However, there have been recent demands for miniaturization of connectors. Smaller connectors have smaller areas for engagement between the retainer and the terminal fittings in a depth direction. In such circumstances, it is desirable to suppress the displacement of the retainer in returning direction as much as possible.

The invention was developed in view of the above problem and an object thereof is to more securely prevent terminal fittings from coming out.

SUMMARY OF THE INVENTION

The invention is a connector with a housing that has at least one cavity. A terminal fitting is insertable into the cavity from behind along an inserting direction. A retainer mount hole is formed in the housing and communicates with the cavity. A retainer can be pushed into the retainer mount hole to engage a retainer lock of the terminal fitting for locking the terminal fitting in the cavity. At least one of the retainer and the housing has a guide that guides the retainer oblique to the inserting direction of the terminal fitting. The guide enables the retainer to push an insufficiently inserted terminal fitting to the proper insertion position. The retainer lock has a biting portion with a pointed end that can bite into a cooperating surface of the retainer.

The retainer mount hole preferably is formed at an intermediate longitudinal position of the housing and opens to three sides of the housing.

The guide for obliquely guiding the retainer with respect to the inserting direction of the terminal fitting preferably is on a portion of the retainer that slides in contact with the housing when the retainer is pushed into the retainer mount hole.

The cavity preferably extends along a connecting direction of the connector housings.

The housing may have a resilient lock for engaging the terminal fitting when the terminal fitting is inserted substantially to a proper depth. Thus, the lock and the retainer cooperate to lock the terminal fitting redundantly. More particularly, the terminal fitting inserted into the cavity from behind and is locked by the resilient lock upon reaching a proper depth. Thereafter, the retainer is pushed into the retainer mount hole and is guided obliquely by the guide. As a result, the retainer engages the terminal fitting to achieve the redundant the locking.

The retainer is displaced oblique to the inserting direction of the terminal fitting from an initially fitted position at the rear of the retainer mount hole to the final mount position at the front of the retainer mount hole.

A terminal fitting may be left lightly inserted without reaching the proper depth. However, the retainer moves obliquely to push the terminal fitting to the proper depth while being and locks the terminal fitting in a proper state.

A force may act on the terminal fitting in withdrawing direction while the terminal fitting is locked by the retainer, and may urge the retainer obliquely back in its withdrawing direction. However, the biting portion on the retainer lock of the terminal fitting bites into the retainer to prevent the retainer tries from moving in the withdrawing direction.

The retainer lock preferably comprises a stabilizer that permits insertion of the retainer or terminal fitting into the cavity when the terminal fitting is in a proper posture. However, the stabilizer interferes with a wall of the cavity to hinder insertion of the retainer or terminal fitting when the terminal fitting is in an improper posture. Accordingly, the biting portion is formed with the existing stabilizer and does not complicate the construction of the terminal fitting.

The retainer lock preferably has a projection adjacent the stabilizer, and the retainer lock and the stabilizer both may engage the retainer. A rear end surface of the projection may be at an angle to the inserting direction and may engage an opposed cooperating surface of the retainer. Accordingly, when the terminal fitting is engaged with the retainer, the pointed end of the stabilizer is held substantially in point contact with the retainer and the projection is held in surface contact with the retainer. Thus, the terminal fitting can have a wider contact area with the retainer as compared to a case where only the stabilizer is provided, and the terminal fitting is prevented from shaking.

The housing preferably comprises a plurality of cavities arranged at two or more stages, and the retainer mount hole communicates with the cavities arranged at the two or more stages. Thus, the retainer can lock the terminal fittings into the cavities arranged at the two or more stages.

These and other objects, features and advantages of the invention will become more apparent upon reading of the following detailed description of preferred embodiments and accompanying drawings. It should be understood that even though embodiments are separately described, single features may be combined to additional embodiments.

DETAILED DESCRIPTION OF THE PREFERRED EMBODIMENTS

Figure 1:
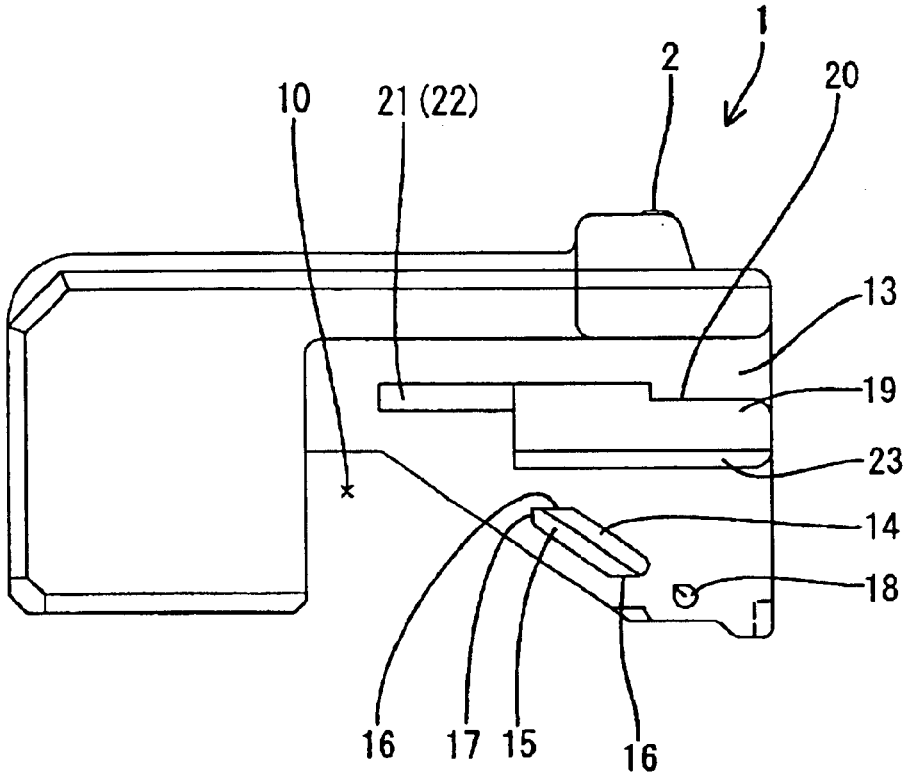
FIG. 1 is a front view of a connector housing.
Figure 2:
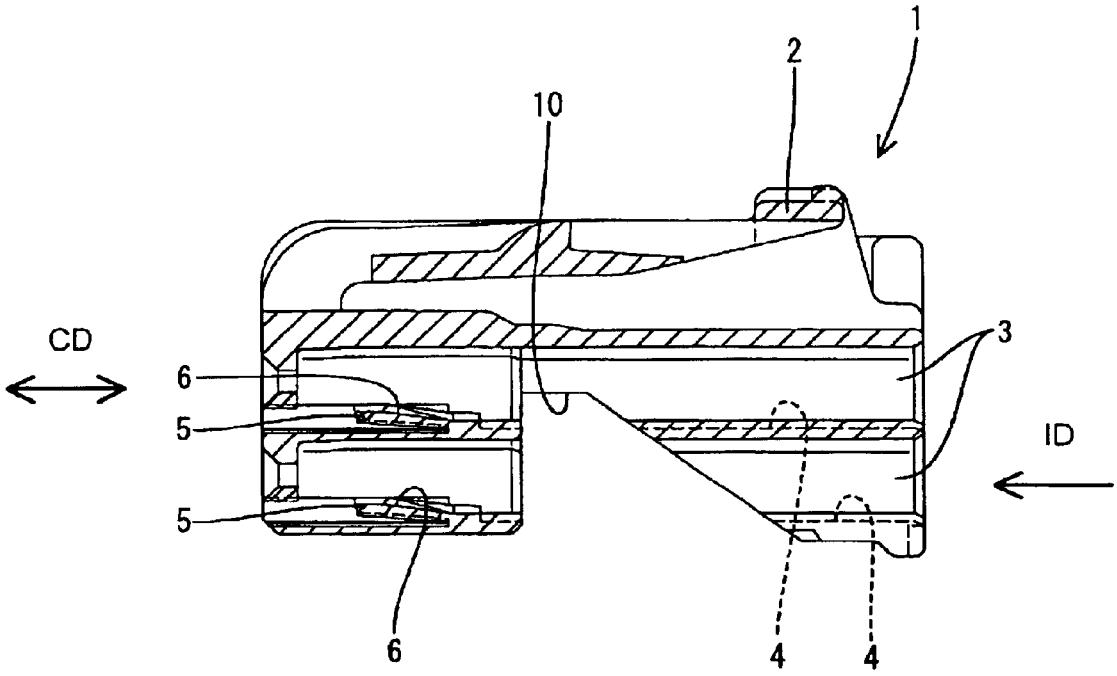
FIG. 2 is section of the connector housing.
Figure 3:
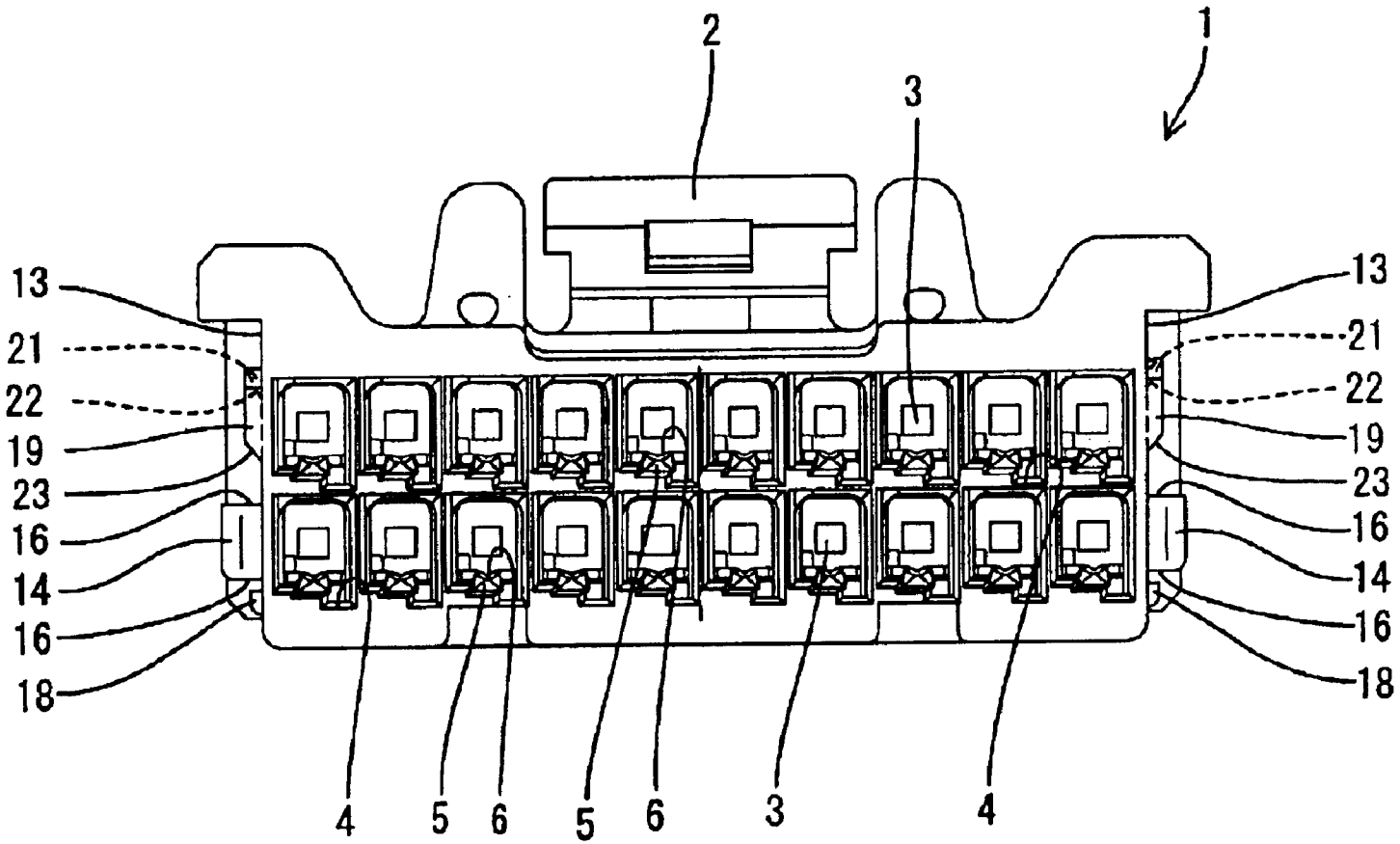
FIG. 3 is a rear view of the connector housing.
Figure 4:
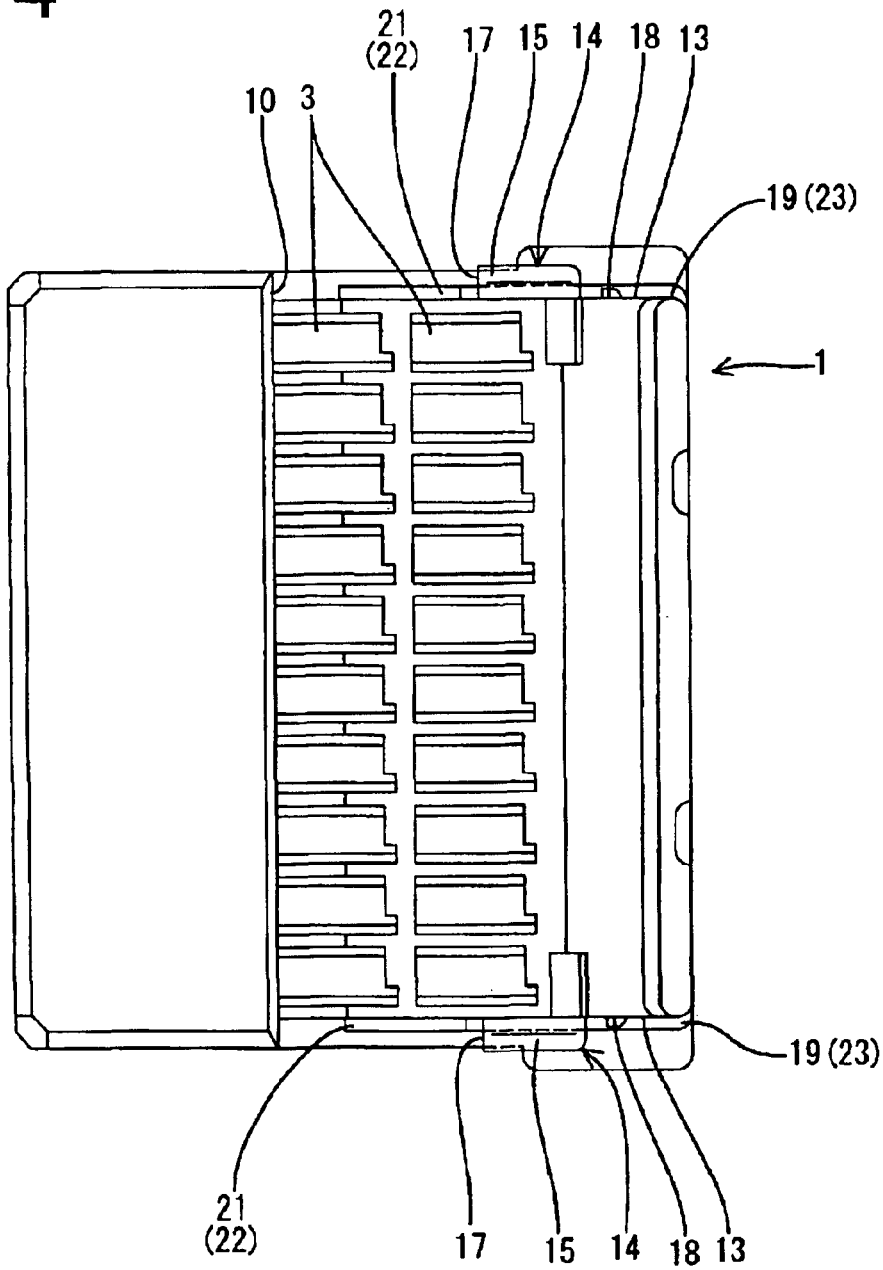
FIG. 4 is bottom view of the connector housing.
Figure 5:
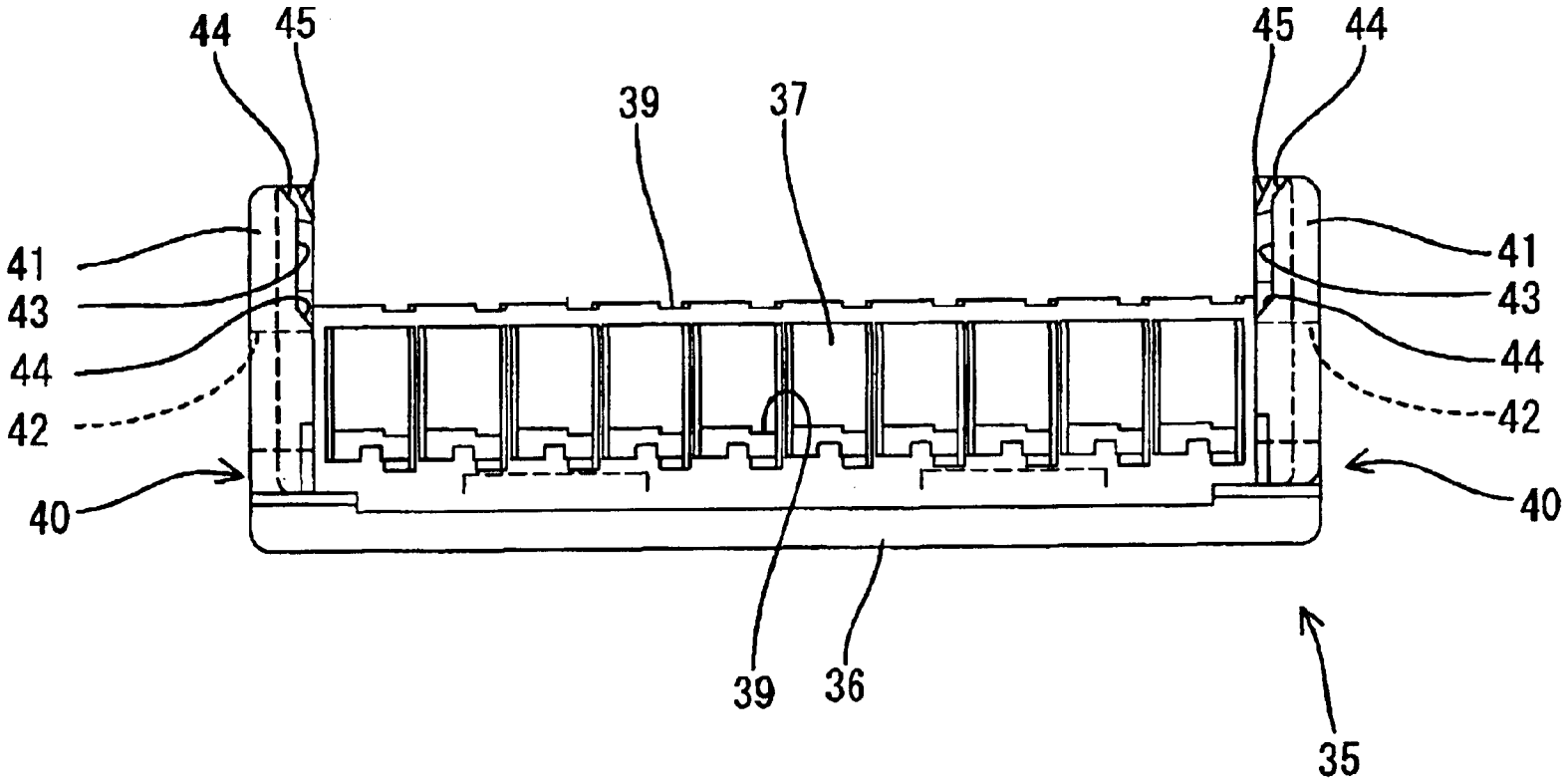
FIG. 5 is a side view of a retainer.
Figure 6:
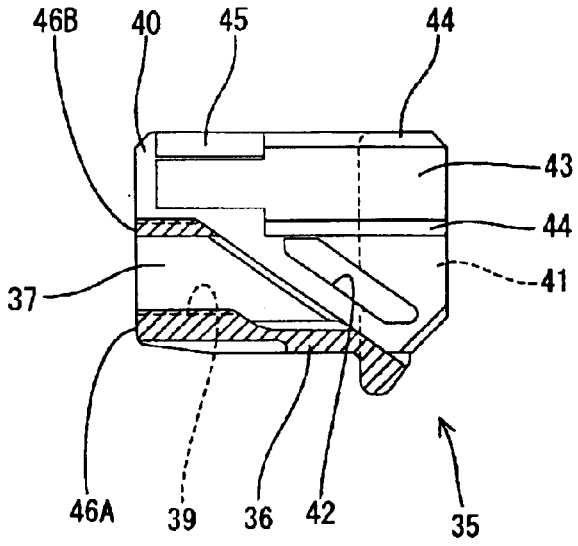
FIG. 6 is a front view in section of the retainer.
Figure 7:
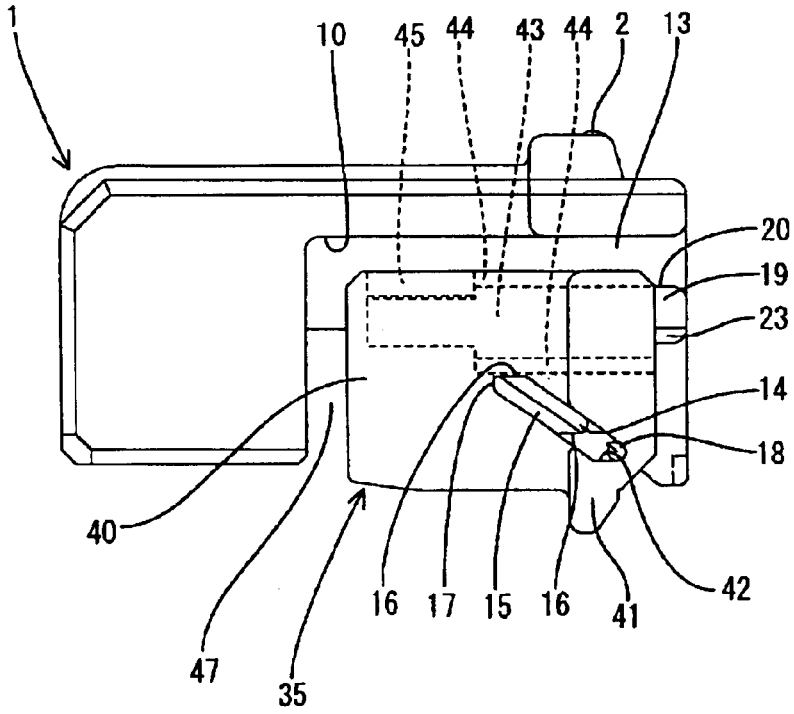
FIG. 7 is a front view of a connector with the retainer partly locked.
Figure 8:
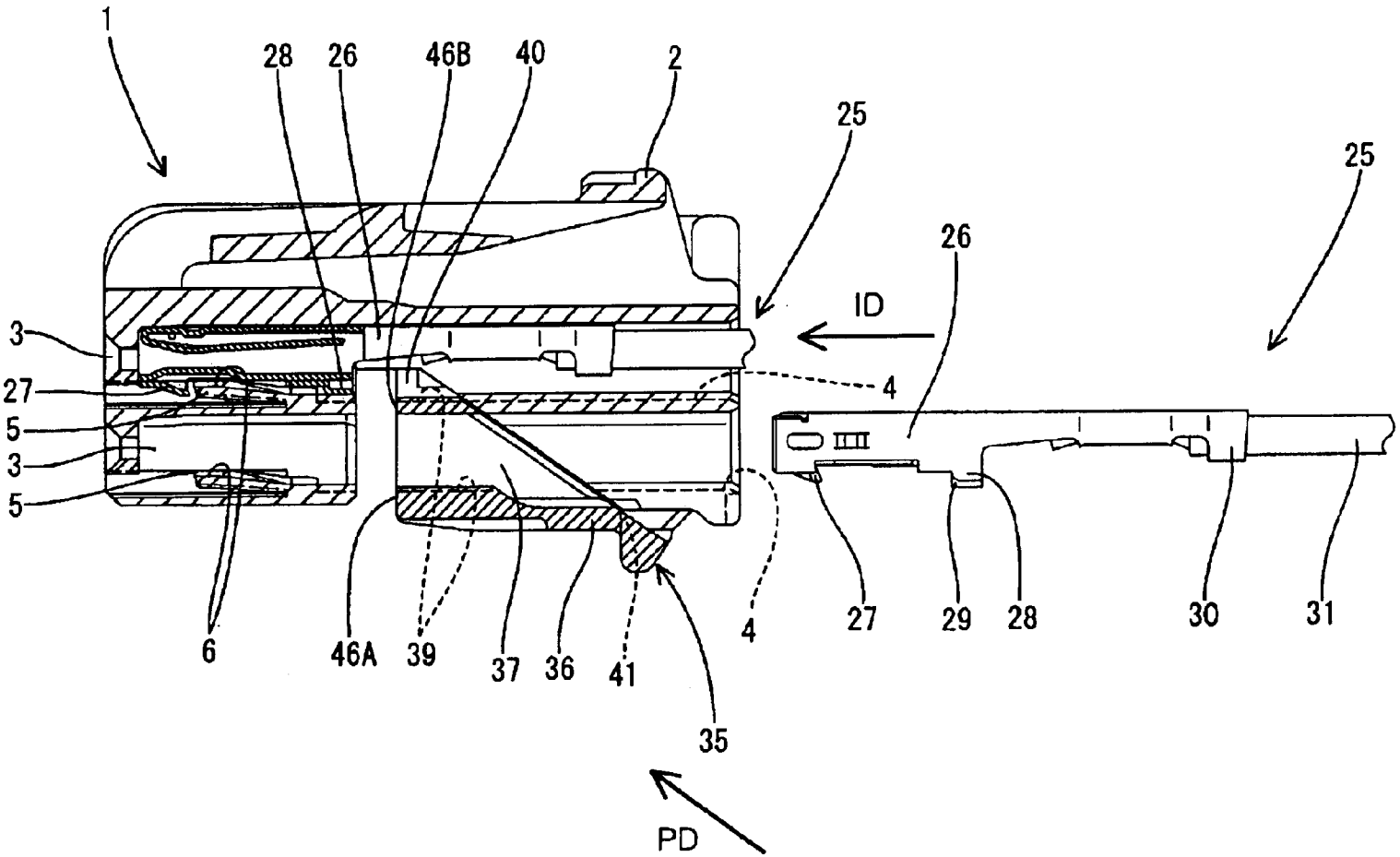
FIG. 8 is a section of the connector when the retainer is partly locked.
Figure 9:
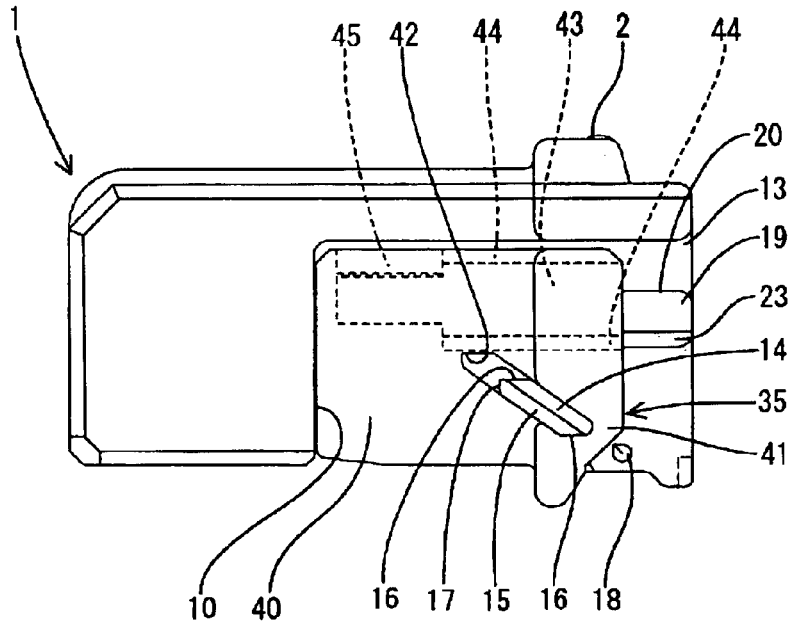
FIG. 9 is a front view of a connector when the retainer is fully locked.

A connector according to the invention has a housing that is identified by the numeral 1 in FIGS. 1 to 14. The housing 1 is made unitarily e.g. of a synthetic resin. A resiliently deformable lock arm 2 is cantilevered from substantially the middle of the upper surface of the housing 1 and is engageable with an unillustrated mating housing to lock the housings in a connected state.

Cavities 3 are arranged substantially along widthwise direction at upper and lower stages inside the housing 1. The respective cavities 3 penetrate the housing 1 along forward and backward directions. An escaping groove 4 is formed at one corner of the bottom surface of each cavity 3. Locks 5 are cantilevered at the front sides of the bottom surfaces of the respective cavities 3. Each lock 5 extends substantially forward along an inserting direction ID and is resiliently deformable along a vertical direction substantially normal to the inserting direction ID. A projection-inserting groove 6 extends along forward and backward directions substantially in the middle of the upper surface of each lock 5. The height of the connector is made shorter by reducing the heights of clearances between the locks 5 and the bottom surfaces of the cavities 3.

The connector also includes terminal fittings 25. Each terminal fitting 25 is formed by bending, folding and/or embossing a metal plate stamped or cut out into a specified shape. The terminal fitting 25 has opposite front and rear ends. A box-shaped main portion 26 is formed at the front end and is configured for receiving a tab of a mating male terminal fitting. A barrel 30 is formed at the rear end and is configured for connection with a wire 31. The bottom wall of the main portion 26 has a double-wall structure with an inner wall 50 and an outer wall 51 placed substantially one over the other. A cut-away 52 is formed across the entire width of the outer wall 51 at substantially a longitudinal middle and has a cut front end surface 53 that is inclined up and to the back. The cut-away 52 divides the outer wall 51 into a front and rear portions 54 and 55. The lock 5 can enter the cut-away 52 over substantially its entire length when the terminal fitting 25 is inserted into the cavity 3, and can engage the front cut end surface 53 of the cut-away 52.

The rear end of the front portion 54 of the outer wall 51 is embossed or cut and bent at the widthwise center to form a locking projection 27 for engaging the lock 5. The rear end of the locking projection 27 overhangs backward substantially along the inclination of the front cut end surface 53 of the cut-away portion 52 and projects more backward than the rear end of the front portion 54 of the outer wall 51.

The rear end of the rear portion 54 of the outer wall 51 is embossed or cut and bent at the widthwise center to form a projection 28. The projection 28 is on substantially the same axis of the locking projection 27 and projects up to substantially the same height as the locking projection 27. The projection 28 is insertable into the projection inserting groove 6. The rear end of the projection 28 projects substantially normal to the inserting direction ID of the terminal fitting 25.

A stabilizer 29 in the form of a substantially flat plate is provided at the side of the projection 28. The stabilizer 29 stands on the rear portion 55 of the outer wall 51 and preferably has a length substantially equal to the length of the projection 28. The stabilizer 29 can be moved forward in the escaping groove 4 of the respective cavity 3. The stabilizer 29 is not aligned with the escaping groove 4 when the terminal fitting 25 is inserted upside down or improperly. Thus, upside-down or improper insertion of the terminal fitting 25 can be prevented.

The rear end of the stabilizer 29 is inclined or rounded up and to the back so that the projecting end thereof is pointed or converging. The pointed end of the stabilizer 29 serves as a biting portion 56 that can bite in the opposed or cooperating surface of the retainer 35 to hold or maintain the retainer 35 at a full locking or second position.

A retainer mount hole 10 is formed at an intermediate longitudinal position of the lower surface of the housing 1, which is the surface opposite the lock arm 2. Additionally, the retainer mount hole 10 is open at three sides and has a depth sufficient to expose the cavities 3 at the upper stage. Thus, the upper and lower cavities 3 each are divided into front and rear sections. The opening edges of the cavities 3 all extend substantially vertically and normal to the inserting direction ID at the front surface of the retainer mount hole 10 but are inclined oblique to the inserting direction ID of the terminal fittings 25 at the rear surface of the retainer mount hole 10.

A stepped surface 13 is defined in area of each side surface of the housing 1 above and behind the side opening of the retainer mount hole 10 and is recessed slightly. A rib-shaped locking projection 14 is formed on the stepped surface 13 and extends substantially along the inclined side of the side opening of the retainer mount hole 10. A bevel 15 extends entirely along a side of each locking projection 14 toward the retainer mount hole 10 with respect to the longitudinal center line thereof, so that the locking projection 14. Horizontal surfaces 16 are formed at the upper and lower ends of each locking projection 14, and a vertical surface 17 is formed substantially continuous with the upper horizontal surface 16.

A push-preventing projection 18 is formed on a downward extension line from each locking projection 14.

A shake-restricting portion 19 projects above the locking projection 14 on each stepped surface 13. Each shake-restricting portion 19 extends substantially horizontally along forward and backward directions and has the upper edge thereof cut away in a stepped manner so that a rear part is slightly narrower. A slanted surface 23 is formed over the entire bottom edge of each shake-restricting portion 19. A hooking piece 21 projects before each shake-restricting portion 19. The hooking pieces 21 have upper edges that are substantially continuous with the upper edges of the corresponding shake-restricting portions 19. A slanted surface 22 is formed at the front of each hooking piece 21 and inclines forward and up.

The connector further includes a retainer 35. The retainer 35 is made e.g. of a synthetic resin similar to the connector housing 1, and has a retainer main body 36 that is fittable into the retainer mount hole 10. Side plates 40 bulge out at the opposite widthwise ends of the retainer main body 36.

Figure 10:
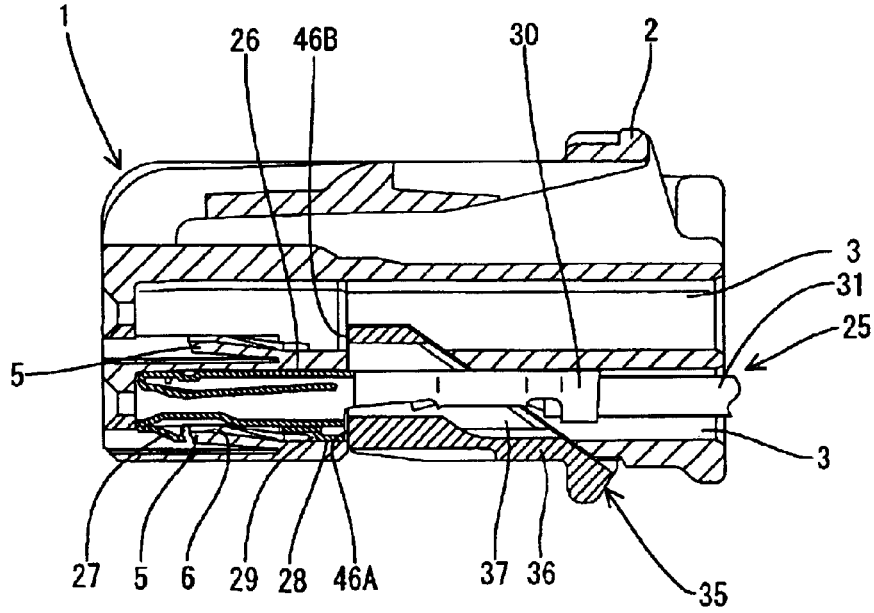
FIG. 10 is a section of the connector when the retainer is fully locked.
Figure 11:
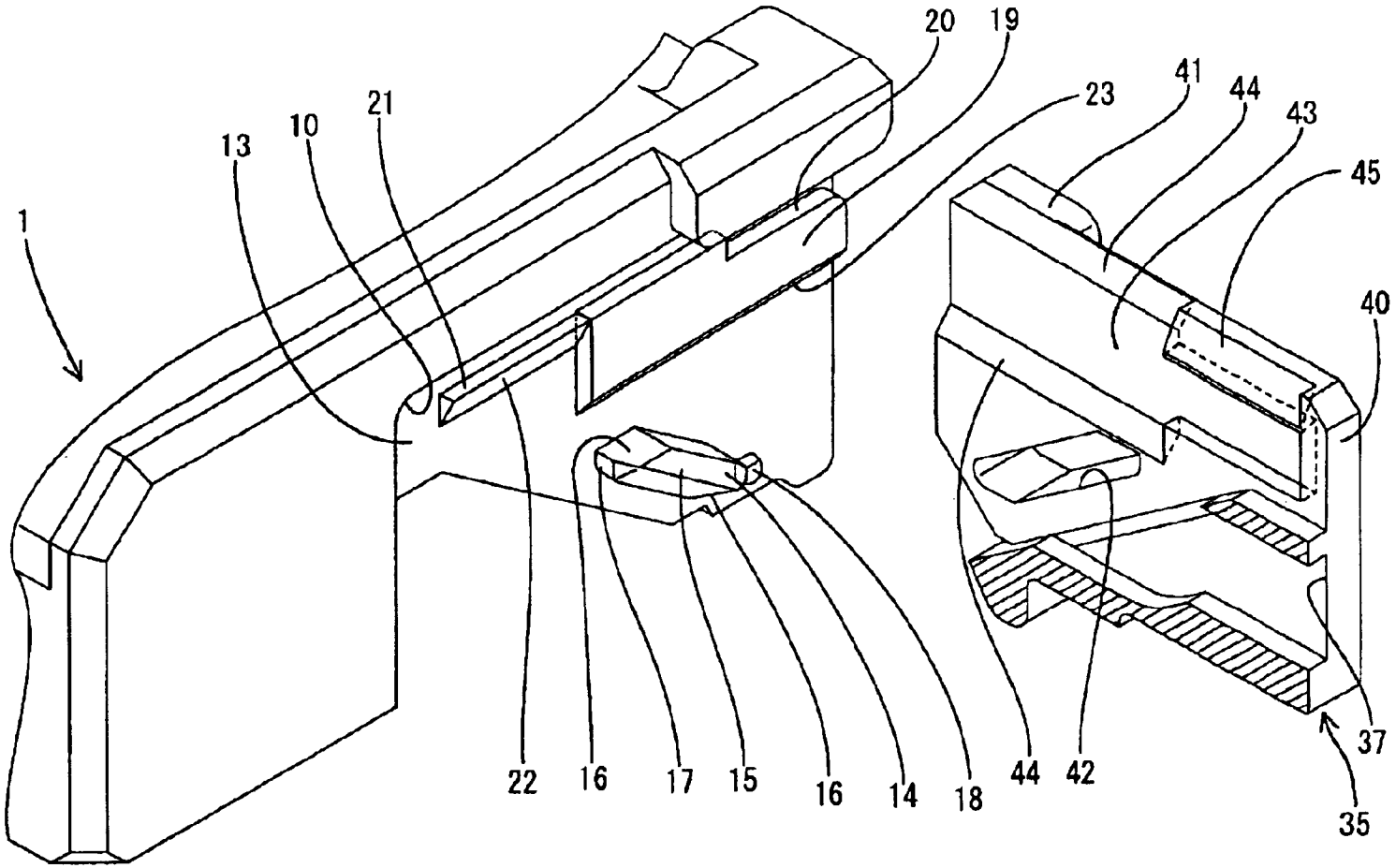
FIG. 11 is a perspective view enlargedly showing portions of the connector near a locking projection and a guide groove.
Figure 12:
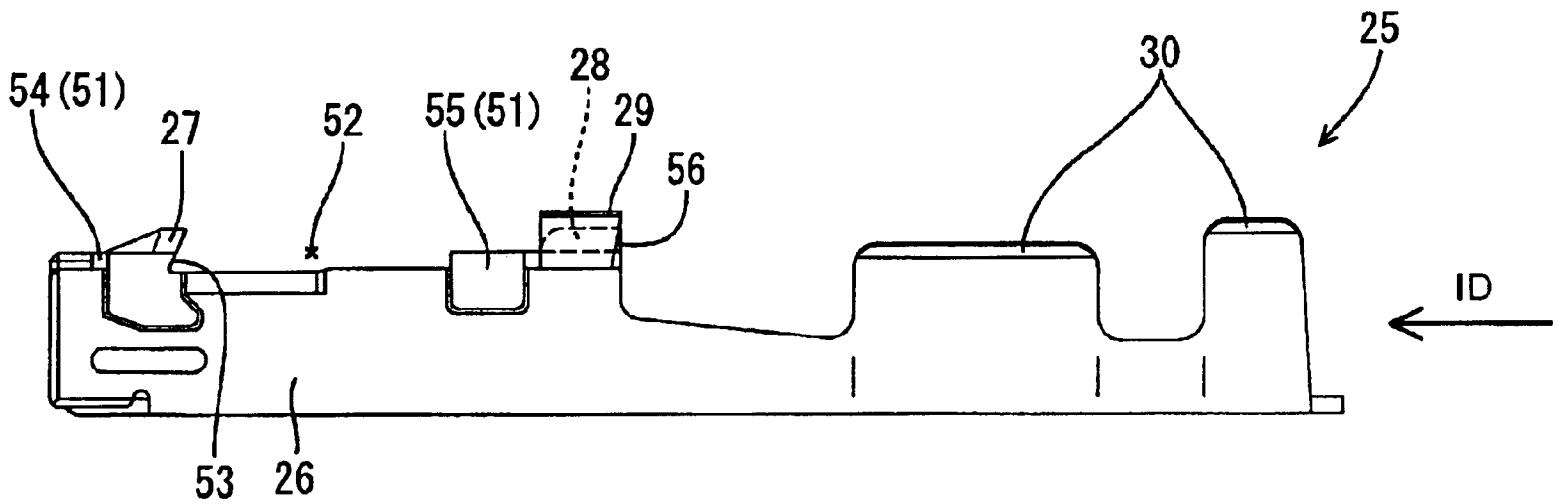
FIG. 12 is a side view of a terminal fitting.
Figure 13:
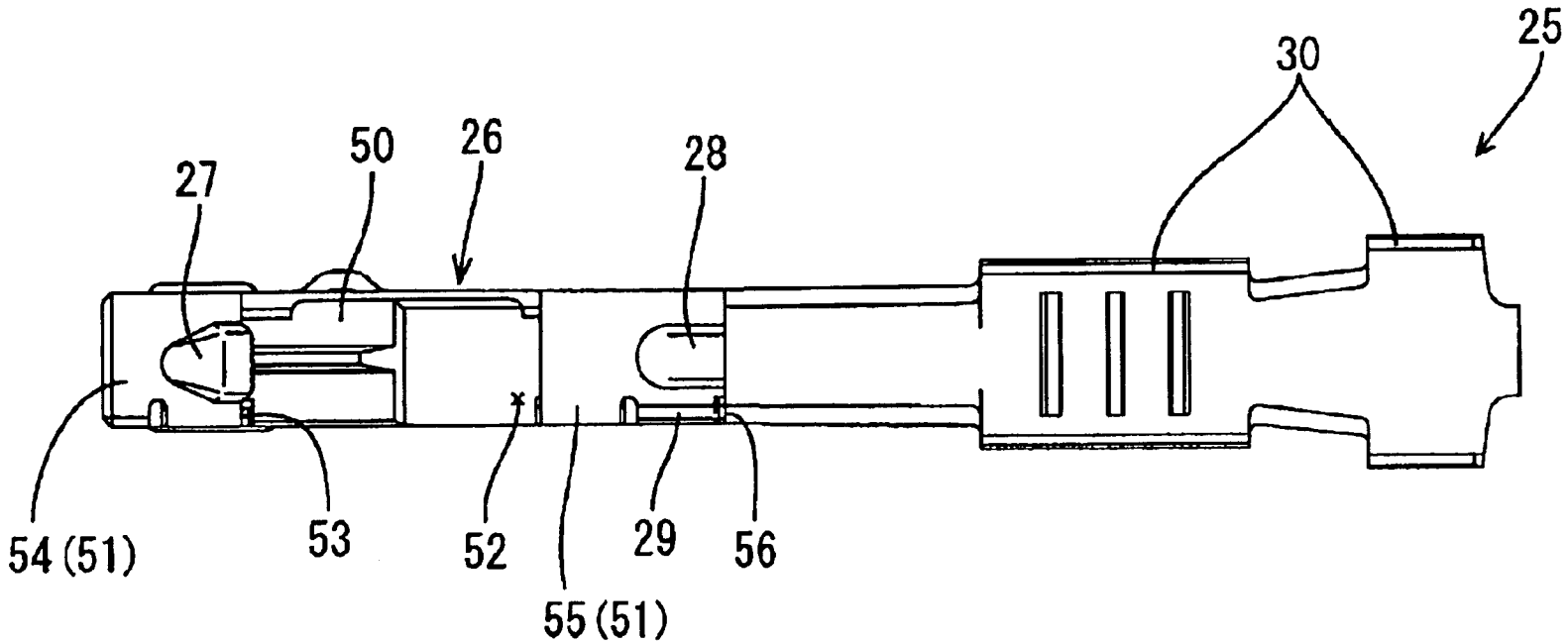
FIG. 13 is a bottom view of the terminal fitting.
Figure 14:
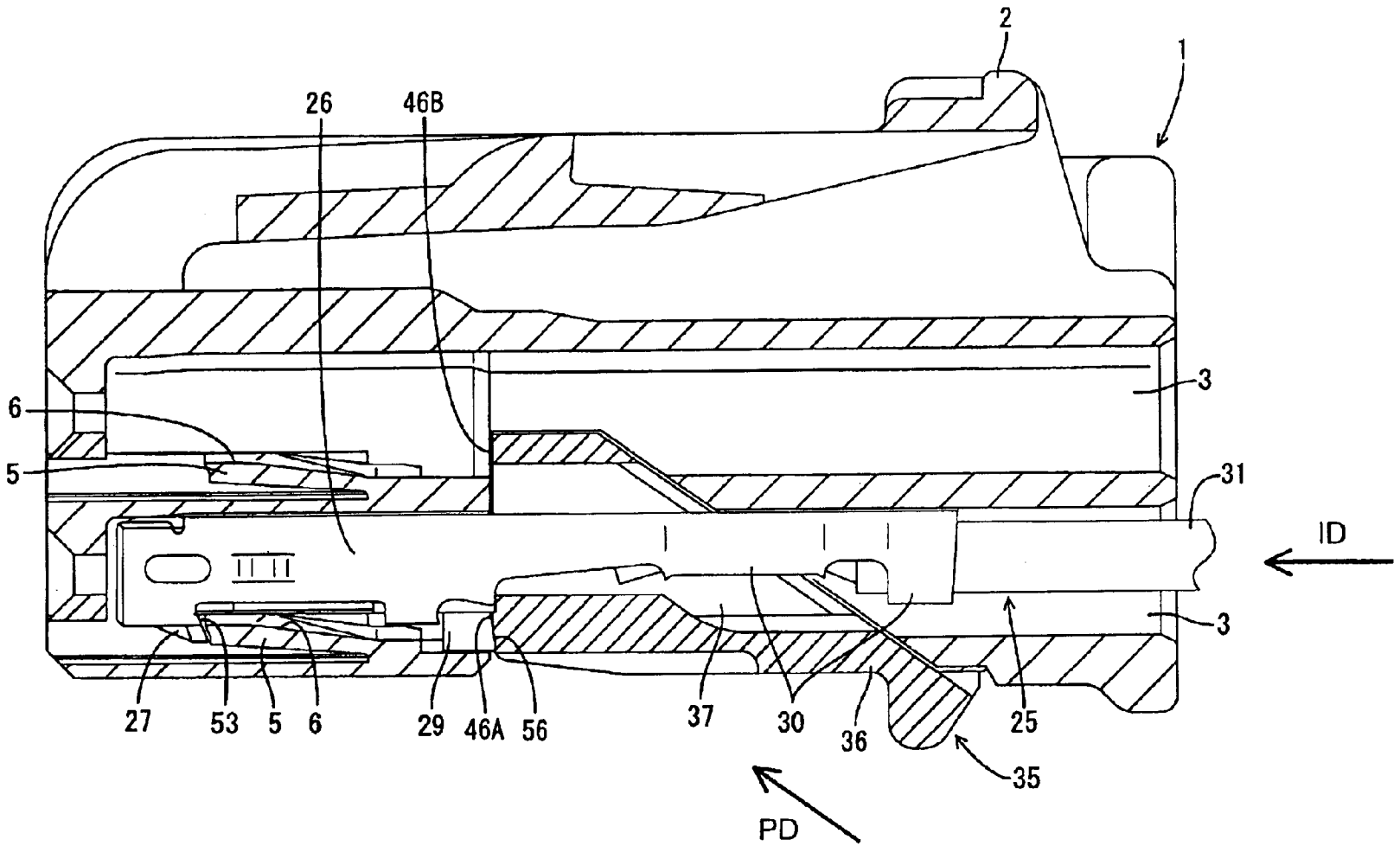
FIG. 14 is a cross-section showing an engaged state of a stabilizer and the retainer.

The retainer main body 36 is formed with windows 37 that are equal in number to the number of cavities 3 at each stage of the housing 1. The respective windows 37 are substantially alignable with the cavities 3 at the lower stage of the housing 1. Front opening edges of the windows 37 extend vertically for alignment with the rear opening edges of the front sections of the cavities 3 divided by the retainer mount hole 10. Rear opening edges of the windows 37 are inclined to conform to the inclination of the front opening edges of the rear sections of the cavities 3. Rear parts of the bottom surfaces of the respective windows 37 are raised slightly. However, front parts and the upper surfaces of the retainer main body 36 are at substantially the same height as the bottom surfaces of the corresponding cavities 3 when the retainer 35 is partly locked to permit insertion and withdrawal of the terminal fittings 25 in the insertion direction ID. The retainer 35 can be moved to a full locking position, as shown in FIG. 10, where the front end surfaces 46A of the bottom walls of the windows 37 and front end surfaces 46B of the upper walls of the retainer main body 36 engage the projections 28 of the terminal fittings 2 to doubly lock the terminal fittings 25 in cooperation with the locks 5.

Stabilizer inserting grooves 39 are formed in the bottom surfaces of the windows 37 and the upper surface of the retainer main body 36 for permitting the passage of the stabilizers 29 of the terminal fittings 25. However, the respective stabilizers 29 and the stabilizer inserting grooves 39 are shifted vertically along the pushing direction PD from each other when the retainer 35 is moved to the full locking position. Thus, the rear end surfaces of the stabilizers 29 engage the wall surface of the retainer 35 located below the front ends of the stabilizer inserting grooves 39.

The opposite side plates 40 of the retainer 35 have a spacing corresponding to the spacing between the opposite side surfaces of the housing 1 and are deformable in opening directions to widen the spacing. The opposite side plates 40 are dimensioned to close the side openings of the retainer mount hole 10 and face specified areas of the corresponding stepped surfaces 13 when the retainer 35 is locked fully. The thickness of the side plates 40 is substantially equal to the depth of the stepped surface 13 from the outer side surfaces of the housing 1, so that the side plates 40 are substantially flush with the corresponding outer surfaces of the housing 1 when the retainer 35 is locked fully. Thus, the side plates 40 of the retainer 35 serve also as outer walls of the sides of the housing 1.

A thick operable portion 41 extends out on the outer surface of the rear of each side plate 40, and the bottom end thereof projects from the bottom surface of the retainer 35. Each side plate 40 has a guide groove 42 behind the retainer main body 36, and each guide groove 42 has substantially the same inclination as the rear opening edges of the windows 37 of the retainer 35. A bottom portion of each guide groove 42 is on the operable portion 41. The guide grooves 42 are substantially as wide as the locking projections 14, and opposite ends of the guide grooves 42 conform to the shapes of the opposite ends of the locking projections 14. The guide grooves 42 engage both the locking projections 14 and the push-preventing projections 18 at their opposite ends to hold the retainer 35 at the partial locking position. The side plates 40 move onto the push-preventing projections 18 when the retainer 35 is moved from the partial locking position to the full locking position to bring the push-preventing projections 18 out of the guide grooves 42. The side plates 40 deform in opening directions during this movement. However, the projecting distance of the locking projections 14 exceeds the projecting distance of the push-preventing projections 18 and keeps the locking projections 14 engaged with the guide grooves 42 even if the side plates 40 are deformed to open wider. In this way, the retainer 35 reaches the fully locked state by moving the locking projections 14 toward the bottom ends of the guide grooves 42.

A restricting recess 43 is formed in the inner surface of each side plate 40 above the guide groove 42 for receiving the corresponding shake-restricting portion 19. Slanted surfaces 44 are formed on the upper and lower edges of the restricting recess 43. The restricting recess 43 has a substantially rectangular shape and extends from a middle position of the side plate 40 to the rear end along the longitudinal direction while extending from the upper end of the guide groove 42 to the upper end of the side plate 40 substantially along the height direction. Upper edges of the shake-restricting portions 19 and upper edges of the restricting recesses 43 align with each other and a specified clearance is defined between the lower edges of the shake-restricting portions 19 and those of the restricting recesses 43 when the retainer 35 is partly locked. The tapered surfaces 23 at the lower edges of the shake-restricting portions 19 substantially align with and contact the slanted surfaces 44 at the lower edges of the restricting recesses 43 to prevent the retainer 35 from making upward shaking movements when the retainer 35 is locked fully.

Locking claws 45 are formed above forwardly extended sections of the restricting recesses 43. The locking claws 45 are at the same height as the hooking pieces 21 of the connector housing 1 and face the hooking pieces 21 when the retainer 35 is partly locked. However, the locking claws 45 move over and engage the upper edges of the hooking pieces 21 when the retainer 35 is fully locked, thereby holding the retainer 35 at the full locking position.

A specified clearance 47 is defined between the front end of the retainer 35 and the front end of the retainer mount hole 10 when the retainer is locked partly, so that the inserted states of the terminal fittings 25 can be confirmed through this clearance 47 from the outside of the housing 1.

The retainer 35 is transported to a site of connecting connectors while being mounted at the partial locking position in the housing 1. The retainer 35 is mounted at the partial locking position by holding the opposite stepped surfaces 13 of the housing 1 from opposite sides by the side plates 40 of the retainer 35. Thus, the locking projections 14 and the push-preventing projections 18 fit into the guide grooves 42. The locking projections 14 and the push-preventing projections 18 engage the opposite ends of the guide grooves 42. Therefore, the retainer 35 is positioned at the partial locking position and is prevented from inadvertent movement to the full locking position. The shake-restricting portions 19 are in the restricting recesses 43 of the retainer 35 at the partial locking position. However, specified clearances are defined between the bottom edges of the shake-restricting portions 19 and those of the restricting recesses 43 in this state.

The bottom surfaces of the windows 37 of the retainer 35 and the upper surface of the retainer main body 36 are substantially flush with the bottom surfaces of the cavities 3 at the upper and lower stages when the retainer 35 is partly locked. Thus, the terminal fitting 25 can be inserted into the cavity 3 in the inserting direction ID and can pass the retainer 35. The locking projection 27 then enters the projection-inserting groove 6 and causes the lock 5 to undergo a necessary and minimum resilient deformation.

The lock 5 is restored resiliently after sufficient insertion of the terminal fitting 25 and the front end of the lock 25 engages the locking projection 27. A clearance 47 exists between the front end of the retainer 35 and the retainer mount hole 10 when the retainer 35 is partly locked, and permits observation of the insides of the cavities 3 to confirm that all terminal fittings 25 have been inserted.

The retainer 35 then is pushed strongly by holding the operable portions 41. Thus, portions of the retainer 35 near the bottom ends of the guide grooves 42 deform to move onto the push-preventing projections 18 and out of the guide grooves 42. The retainer 35 then is pushed obliquely up and in on the housing 1 along the pushing direction PD and is guided by the engagement of the locking projections 14 and the guide grooves 42. The locking projections 14 are held in sliding contact with the guide grooves 42. Therefore, the retainer 35 can be pushed in a stable posture without being inclined or tilted in clockwise direction in FIG. 7.

The front end surfaces 46A of the bottom walls of the windows 37 and the front end surfaces 46B of the upper walls of the retainer main body 36 engage the projections 28 of the terminal fittings 25 when the retainer 35 reaches the full locking position to doubly lock the terminal fittings 25 in cooperation with the locks 5 in the housing 1. At the full locking position, the locking projections 14 engage the bottom ends of the guide grooves 42, but the push-preventing projections 18 are outside the operable portions 41. The locking claws 45 move over the slanted surfaces 22 of the hooking pieces 21 and engage the upper edges of the hooking pieces 21 at this time. Thus, the retainer 35 is locked at the full locking position. Further, the bottom edges of the shake-restricting portions 19 engage the bottom edges of the restricting recesses 43 to prevent the retainer 35 from moving up.

The front surface of the retainer main body 36 substantially abuts the front surface of the retainer mount hole 10 when the retainer 35 reaches the fully locked state. As a result, the retainer 35 closes the retainer mount hole 10 to prevent dust and the like from entering the cavities 3.

A pulling force may act on the wire 31 connected with the terminal fitting 25 when the retainer 35 is fully locked, and thus the retainer 35 may try to move obliquely backward. The locking projections 14 engage the guide grooves 42 and the shake-restricting portions 19 engage the restricting recesses 43 to resist backward movement of the retainer 35. Additionally, the biting portion 56 of the stabilizer 29 bites in the front-end surface 46A of the bottom wall of the corresponding window 37 of the retainer 35 or the front end surface 46B of the retainer main body 36. Thus, the backward movement of the retainer 35 is prevented.

Both the projection 28 and the stabilizer 29 of the terminal fitting 25 engage the retainer 35 in this embodiment. Conceivably, the projection 28 could be omitted and the stabilizer 29 could be the only engageable portion. However, this would achieve a point contact with the retainer 35 because the biting portion 56 defines a pointed end. In this respect, the terminal fitting 25 can be held more stably in this embodiment since the rear end of the projection 28 is a vertical surface held in surface contact with the retainer 35, thereby increasing a contact area with the retainer 35.

The terminal fitting 25 could be inserted insufficiently and left unlocked by the lock 5. This insufficiently inserted terminal fitting 25 can be brought automatically to the proper position since the retainer 35 pushes the projection 28 of the terminal fitting 25 during its oblique movement in the pushing direction PD. If the terminal fitting 25 is inserted more lightly than the above insufficiently inserted state, the retainer 35 interferes with the bottom surface of the main portion 26 of the terminal fitting 25 even if an attempt is made to push the retainer 35. Thus, the retainer 35 cannot be pushed any further and an operator can detect that the terminal fitting 25 is distant from its proper insertion position.

The terminal fittings 25 may need to be withdrawn for maintenance or other reason. In such a case, a disengagement jig is inserted into clearances inside the inner surfaces of the side plates 40 of the retainer 35 between the operable portions 41 and the cut-away portions 20 to forcibly open the side plates 40 wider. The retainer 35 then is moved back and obliquely down. The retainer 35 reaches the partial locking position when the push-preventing projections 18 fit into the guide grooves 42. Another disengagement jig then is inserted from front of the connector housing 1 to disengage the lock 5 so that the terminal fitting 25 can be withdrawn.

The engagement of the guide grooves 42 and the locking projections 14 enables the retainer 35 to be guided smoothly and stably in the intended direction from the partial locking position to the full locking position. Thus, the retainer 35 and the terminal fittings 25 engage properly at the full locking position. Therefore, the retainer 35 accurately detects the inserted states of the terminal fittings 25.

The retainer mount hole 10 is open in the side surfaces of the connector housing 1 in this embodiment. However, the side plates 40 close these side openings when the retainer 35 reaches the full locking position. Accordingly, the side plates 40 of the retainer 35 also serve as the outer walls of the housing 1, and the entire connector is narrower than connectors in which the retainer mount hole 10 is not open in the side surfaces and the side plates 40 of the retainer 35 are placed on the side surfaces of the housing 1.

The cavities 3 at the upper and lower stages in the connector are locked by one retainer rather than by separate upper and lower retainers. Thus, the number of parts and the number of operation steps can be reduced.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the biting portion 56 is provided at the stabilizer 29 in the foregoing embodiment, it may be provided at the projection 28.

Although the terminal fitting 25 is a female terminal fitting in the foregoing embodiment, it may be a male terminal fitting.

What is claimed is:

1. A connector, comprising:

a housing formed with at least one cavity for receiving a terminal fitting along an inserting direction, a retainer mount hole formed in the housing and communicating with the cavity; and a retainer insertable into the retainer mount hole to engage a retainer locking portion on the terminal fitting, thereby locking the terminal fitting;

wherein at least one of the retainer and the housing comprise a guide for obliquely guiding the retainer with respect to the inserting direction of the terminal fitting and for pushing the terminal fitting to a proper position in the cavity; and the retainer locking portion comprising a biting portion with a pointed end facing toward a cooperating surface of the retainer for biting in the cooperating surface of the retainer.

2. The connector of claim 1, wherein the retainer mount hole is formed at an intermediate longitudinal position of the housing so as to be open to three sides thereof.

3. The connector of claim 1, wherein the guide for obliquely guiding the retainer with respect to the inserting direction is on a portion of the retainer held substantially in sliding contact with the housing when the retainer is pushed into the retainer mount hole.

4. The connector of claim 1, wherein the cavity is formed substantially along a connecting direction of the housing.

5. The connector of claim 1, further comprising a resiliently deformable lock in the cavity for engaging the terminal fitting when the terminal fitting is inserted to a proper position, wherein the lock doubly locks the terminal fitting in cooperation with the retainer.

6. The connector of claim 1, wherein the housing has a plurality of cavities arranged at a plurality of stages, the retainer mount hole communicating with the cavities at each of the stages, and wherein the retainer is configured for locking the terminal fittings into the cavities at each of the stages.

7. The connector of claim 1, wherein the retainer locking portion comprises a stabilizer disposed for permitting insertion of the terminal fitting into the cavity when the terminal fitting is in a proper orientation while interfering with a wall surface of the cavity to hinder the insertion of the terminal fitting when the terminal fitting is inserted in an orientation different from the proper orientation.

8. The connector of claim 7, wherein the retainer locking portion comprises a projection projecting adjacent the stabilizer and engageable with the retainer together with the stabilizer for locking the retainer, a rear end of the projection being at an angle to the inserting direction and being engageable with the cooperating surface of the retainer.

9. A connector, comprising:

a housing formed with a plurality of cavities extending along an inserting direction, a retainer mount hole formed in the housing and communicating with each of the cavities;

terminal fittings mounted respectively in the cavities, each said terminal fitting having a projection and a stabilizer, the projection having a rear end aligned substantially normal to the inserting direction, the stabilizer having a pointed rear end, the rear ends of the projection and the stabilizer being substantially aligned with the retainer mount hole when the respective terminal fitting is mounted properly in the respective cavity; and a retainer insertable into the retainer mount hole and having cooperating surfaces for engaging the rear ends of the projection and the stabilizer on each of the terminal fittings, thereby locking the terminal fittings in the respective cavities.

10. The connector of claim 9, further comprising a resiliently deformable lock in the cavity for engaging the terminal fitting when the terminal fitting is inserted to a proper position, wherein the lock doubly locks the terminal fitting in cooperation with the retainer.

11. The connector of claim 9, wherein the housing is formed with a groove for receiving the stabilizer when the terminal fitting is in a proper orientation while interfering with a wall surface of the cavity to hinder the insertion of the terminal fitting when the terminal fitting is inserted in an orientation different from the proper orientation.

12. The connector of claim 9, wherein the pointed rear end defines an acute angle.

13. The connector of claim 12, wherein the retainer and the housing comprise guides for obliquely guiding the retainer with respect to the inserting direction of the terminal fitting and for pushing any insufficiently inserted terminal fitting to a proper position in the cavity.

14. The connector of claim 13, wherein the retainer mount hole is formed at an intermediate longitudinal position of the housing so as to be open to three sides of the housing.

* * * * *